United States Patent [19]

Jakimowicz et al.

[11] Patent Number: 4,945,746

[45] Date of Patent: Aug. 7, 1990

[54] CONTAINMENT FENCE FOR RUNOUT TABLE

[75] Inventors: Christopher C. Jakimowicz, Utica; James H. Ramey, Newport, both of Mich.

[73] Assignee: National Steel Corporation, Pittsburgh, Pa.

[21] Appl. No.: 290,276

[22] Filed: Dec. 27, 1988

[51] Int. Cl.[5] ..... B21B 39/16

[52] U.S. Cl. ..... 72/251; 72/428; 198/836.1

[58] Field of Search ..... 72/250, 251, 428; 198/836

[56] References Cited

U.S. PATENT DOCUMENTS

| | | | |
|---|---|---|---|
| 1,061,676 | 5/1913 | Kennedy | 198/836 |
| 2,006,764 | 7/1935 | Hudson | 72/250 |
| 3,193,077 | 7/1965 | Goldberg | 198/836 |
| 4,054,276 | 10/1977 | Wilson | 266/106 |
| 4,423,856 | 1/1984 | Takahashi et al. | 266/106 |
| 4,502,594 | 3/1985 | Sijbrandis | 198/836 |

*Primary Examiner*—Lowell A Larson
*Assistant Examiner*—Thomas C. Schoeffler
*Attorney, Agent, or Firm*—O'Neil and Bean

[57] ABSTRACT

An improved containment fence for a roller conveyor type runout table used with a hot strip mill includes a plurality of vertically extending posts mounted in fixed relation to and outboard of the conveyor rollers along each side of the runout table with the posts each terminating in a top end spaced above the conveying path defined by the rollers, and a plurality of fence plate assemblies each including an elongated generally rectangular plate and a pair of rigid mounting brackets on and extending outwardly from one surface of each elongated plate one adjacent each end thereof for mounting the plates on the upper end of the upwardly projecting posts and adjacent the ends of the rollers of the conveyor, each plate assembly having a length to extend past the ends of a plurality of adjacent rollers on the conveyor, and the posts and mounting brackets supporting the plates in overlapping relation along the length of the conveyor with a downstream end of each elongated plate extending inboard of the upstream end of the next adjacent elongated plate whereby the elongated plates along each side of the conveyor path form a continuous fence free from protrusions capable of impeding movement of a strip along the conveyor path.

7 Claims, 3 Drawing Sheets

CONTAINMENT FENCE FOR RUNOUT TABLE

BACKGROUND OF THE INVENTION

1. Field of the Invention

This invention relates to runout tables for metal strip mills, and more particularly to an improved containment fence for the runout table of a hot strip finishing mill.

2. Description of the Prior Art

Metal strip produced on a hot strip finishing line is conventionally coiled by coilers spaced a substantial distance from the final stand of the finishing line. A runout table in the form of a driven roller conveyor supports the strip as it moves from the final mill stand to the coiler. The temperature of the strip issuing from the mill is too hot for immediate coiling and must be cooled in its path along the runout table to avoid undesired metallurgical changes in the coil. The high speed and temperature of the strip discharged from the final mill stand may require the coiler to be spaced up to 500 feet, or more, from the final stand even though a large volume of cooling water is applied to both the top and bottom surfaces of the strip in its path along the runout table.

Strip is conveyed along the runout table under low or substantially no tension by the action of the motor driven rollers of the conveyor. In travelling this distance at relatively high speeds, the strip can drift from the center of the conveyor, especially at the free ends of a strip. In the past, a vertically extending plate has been provided at the end of each roller to act as a side guide containing the strip on the conveyor surface. These side guide plates generally were mounted between the end of the roller surface and the supporting bearing and could be mounted on the bearing block itself. These upwardly projecting plates at each end of the rollers cooperated to provide, in effect, a picket-line containment fence along each side of the conveyor path for containing the strip. The individual plates for each roll enabled individual rollers to be removed for service when necessary.

While a containment fence consisting of a series of parallel, closely spaced individual plates projecting upwardly at the end of each roller is effective in containing the strip on the conveyor surface, this arrangement is not entirely satisfactory in that adjacent edges of consecutive plates are not always perfectly aligned. This is particularly true after substantial use because individual plates may become damaged or distorted with the result that a projecting edge can engage the side edge of a hot, fast moving strip. This can produce sufficient damage to interfere with coiling of the strip or even, in severe cases, result in a cobble on the conveyor surface, particularly when the leading end of a strip catches on a fence plate.

A primary object of the present invention is, therefore, to provide an improved containment fence structure for a hot strip mill runout table.

Another object is to provide such an improved containment fence structure which provides ready access to the individual rollers, roller bearings and drive motors of the runout table conveyor while providing a substantially continuous guide fence surface free from any projecting edges capable of engaging and damaging a hot strip edge moving on the table.

SUMMARY OF THE INVENTION

The foregoing and other objects and advantages are achieved in accordance with the present invention wherein the containment fence comprises a plurality of elongated fence plates removably mounted at the sides of the runout table conveyor adjacent to the ends of the rollers, with each plate extending past a plurality of rollers. The fence plates along each side of the conveyor extend in overlapping relation such that no exposed edge surfaces are presented in a direction to engage and damage the edges of the hot strip. The individual fence plates are supported on the upwardly projecting ends of vertically extending posts, each of which has its lower end rigidly mounted below the conveyor rollers and preferably on the conveyor support frame structure. The posts extend upwardly between an adjacent pair of roller shafts whereby access to the rollers for maintenance is not obstructed by the fence structure. Longitudinally extending braces may be provided between adjacent pairs of posts along each side of the runout table conveyor, and transverse braces may be provided between posts on opposed sides of the conveyor, with the transverse braces extending between an adjacent pair of rolls at a level below their top conveying surfaces so as not to interfere with the conveyor path. Suitable sleeves are mounted on the opposed end portions of the respective fence plates in position to be telescopingly received on the upwardly projecting ends of the support posts for easy installation and removal.

BRIEF DESCRIPTION OF THE DRAWINGS

Other features and advantages of the invention will be apparent from the detailed description contained hereinbelow, taken in conjunction with the drawings, in which.

DESCRIPTION OF THE PREFERRED EMBODIMENT

Figure 5:
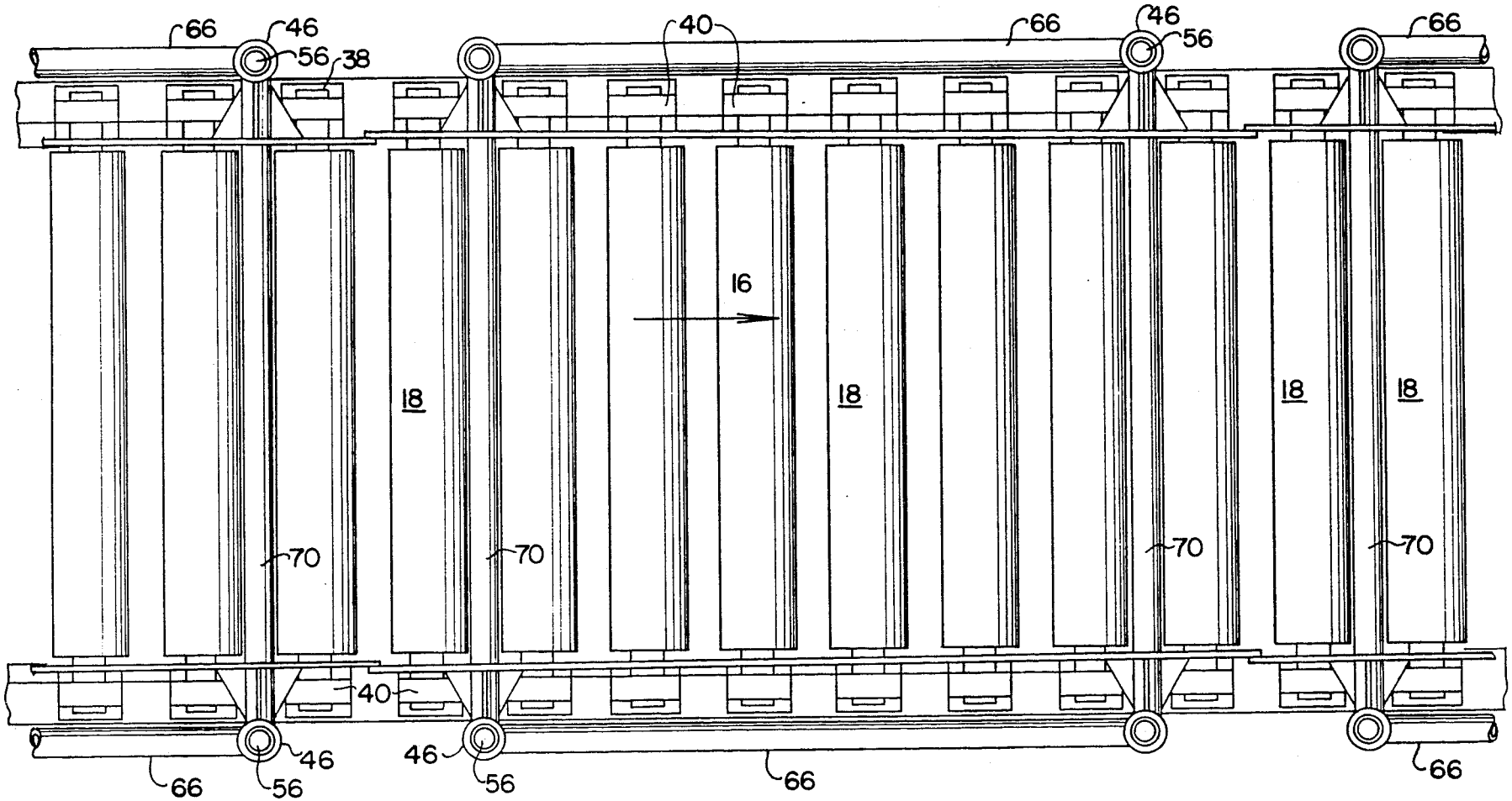
FIG. 5 is a top plan view of the structure shown in FIG. 3.

Referring now to the drawings in detail, apparatus for conveying and cooling hot metal strip moving from a finish line to a coiler is designated generally by the reference numeral 10, and comprises an elongated runout table 12 extending between the final mill stand, not shown, and the coiler, also not shown. Hot strip 14 leaves the final stand of the rolling mill and moves over the runout table in the direction of arrow 16 as seen in FIG. 5. The runout table 12 comprises a driven roller conveyor made up of a series of parallel rollers 18 each driven by a suitable motor 20.

Figure 1:
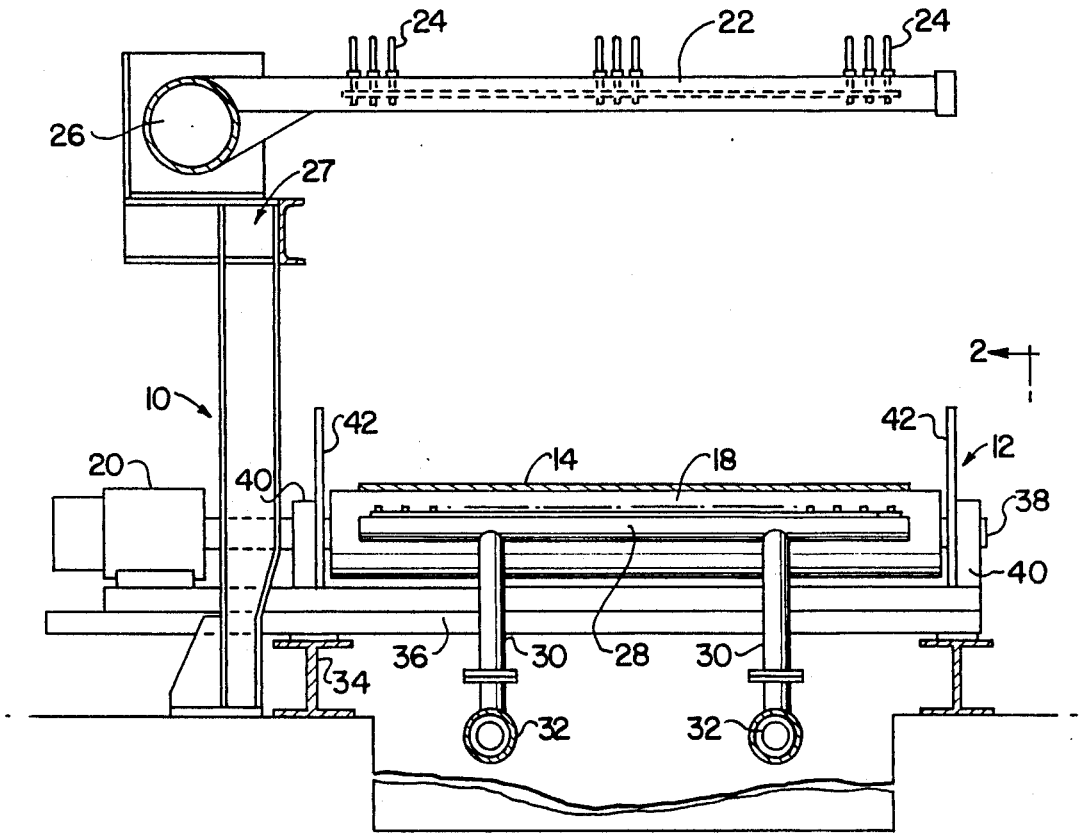
FIG. 1 (PRIOR ART)
FIG. 1 is an elevation view, in section, of a prior art hot strip mill runout table.

In a typical installation, runout table 12 will be several hundred feet long, and a water cooling system consisting of a number of banks of water spray bars located above and below the conveying surface are positioned along the length of the table. In the prior art installation illustrated in FIG. 1, a typical top spray bar 22 extends transversely of the conveyor above the strip 14 and a plurality of laminar flow nozzles 24 spaced along the length of the bar are provided for directing streams of cooling water downwardly onto the top surface of the strip. A water supply header 26 is supported on pedestals 27 and extends along and above the conveyor to provide water to a plurality of the spray bars 22. One of a plurality of bottom spray bars 28 is also illustrated in FIG. 1, and each spray bar 28 extends between a pair of adjacent rollers. Risers 30 connected to water mains 32 supply cooling water to the spray bars 28.

Rollers 18 and their drive motors 20 are supported on a frame assembly including a pair of laterally spaced longitudinally rigid beams 34 connected at spaced intervals by transversely extending joist 36. The projecting ends of shaft 38 of each roller 18 extends through and is supported by a pair of journal bearings 40 rigidly mounted on the beams 34 as by suitable mounting blocks 41.

Figure 2:
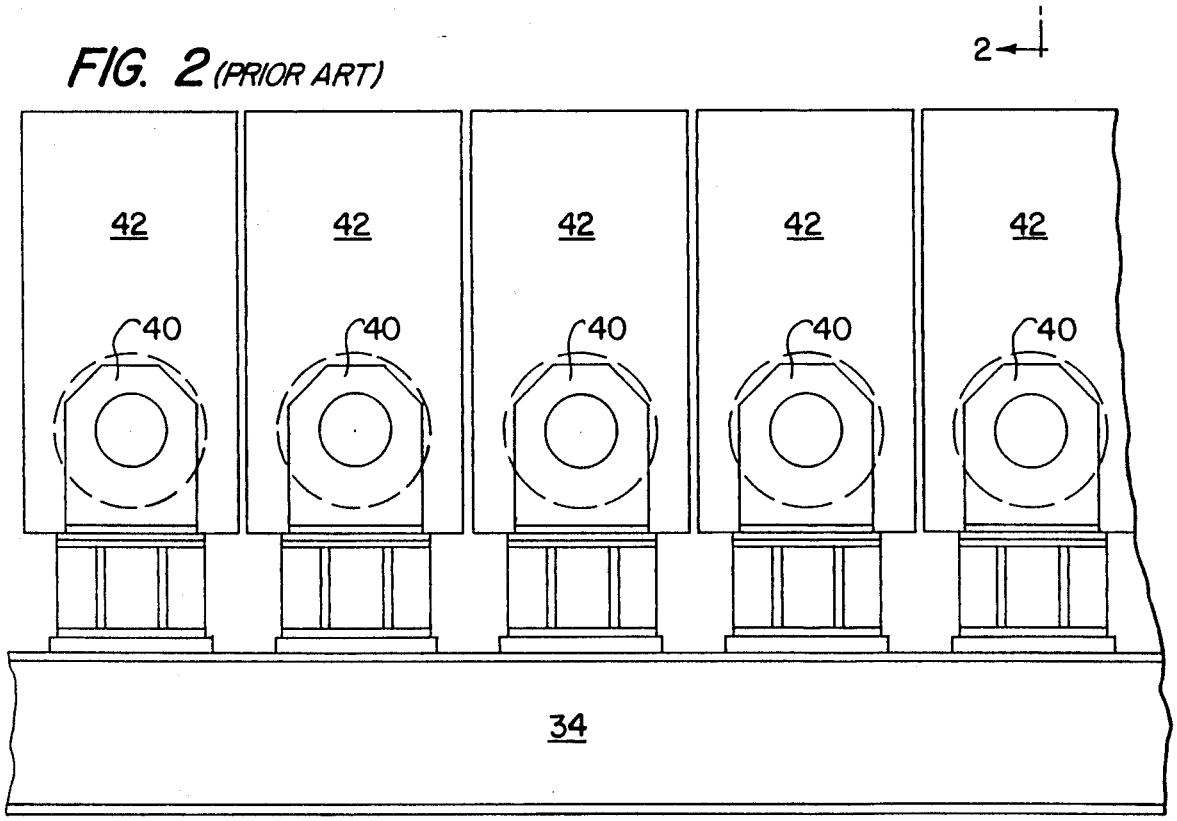
FIG. 2 (PRIOR ART)
FIG. 2 is an enlarged fragmentary side elevation view taken along line 2—2 of FIG. 1.

The apparatus thus far described is conventional and in such prior art apparatus shown in FIGS. 1 and 2, a containment fence is provided in the form of a series of upwardly projecting rigid plate members 42 suitably mounted as by bolting to the housing of the respective bearings 40 at a location between the bearing and the adjacent end of the roller 18. Plates 42 are generally rectangular in shape and dimensioned to provide clearance between adjacent plates, when assembled, to facilitate removal of individual rolls, as for maintenance. Over an extended period of use, the individual plates 42 of the prior art containment fence could become distorted as from impact with a strip during a cobble or the like. For reasons pointed out below, this spacing between adjacent plates 42 can and do present problems during operation.

As indicated above, with hot strip 14 moving at a high rate of speed over the conveying surface of a runout table for several hundred feet, the strip can drift to one side of the conveyor, bringing the edge of the hot strip into contact with the inwardly directed flat surface of the containment fence defined by the upwardly extending plates 42. The free leading ends of a strip present particular problems in this respect. With plates 42 in perfect alignment, their inwardly directed surface presents a substantially continuous smooth barrier surface acting as a side guide to engage the edge of a strip to contain it on the runout table. In practice however, when adjacent plates become misaligned or distorted, the upstream edge of a plate can present a sharp corner which can disrupt movement of the strip or bite into and damage the fast moving hot strip edge or end. In extreme cases, such strip damage can be so severe as to interfere with coiling of the strip or even result in a cobble requiring shutdown of the mill.

Figure 3:
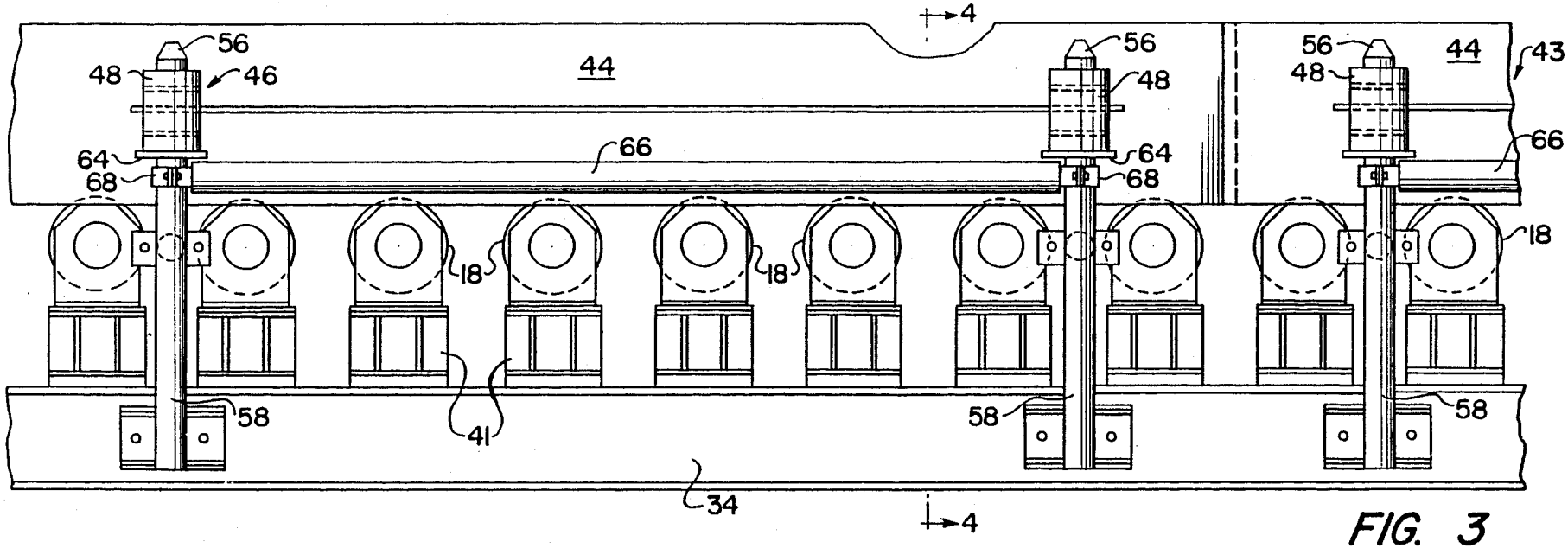
FIG. 3 is a view similar to FIG. 2, on a reduced scale, showing the containment fence of the present invention.
Figure 4:
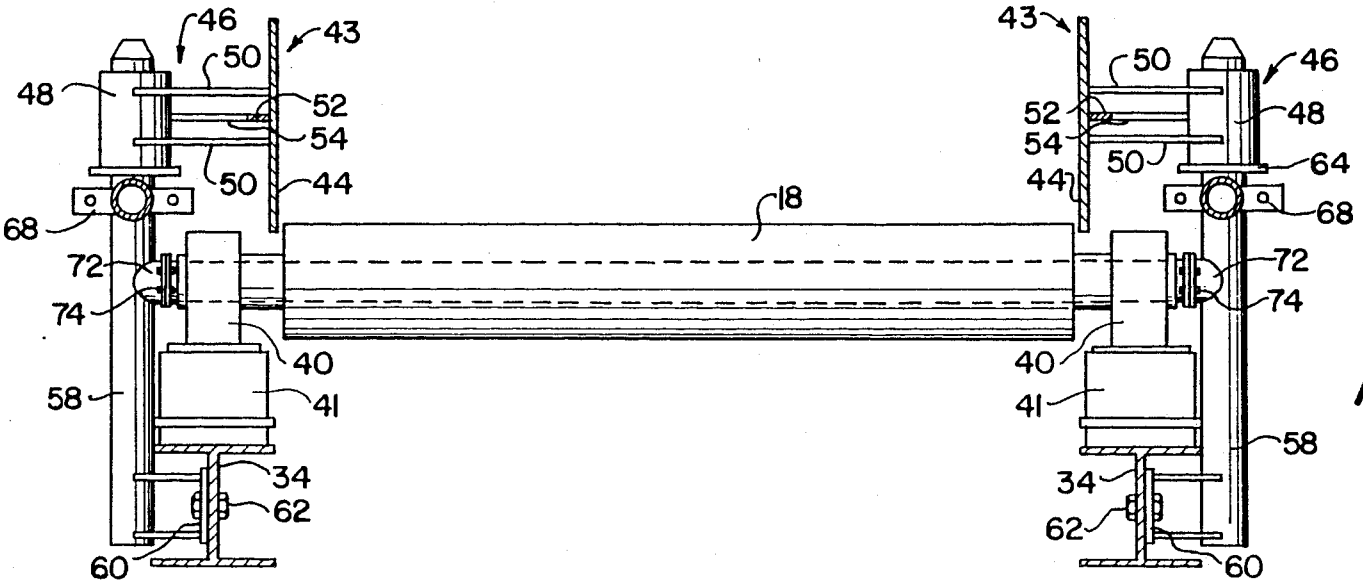
FIG. 4 is a sectional view taken along line 4—4 of FIG. 3.

The containment fence according to the present invention, illustrated in FIGS. 3–5 of the drawings, presents a continuous barrier surface along each side of the runout table conveyor which overcomes the difficulties presented by the prior ar containment fence just discussed. The improved fence comprises a plurality of elongated plate assemblies 43 supported in overlapping relation along each side of the conveyor at the ends of the conveyor rolls 18. Plate assemblies 43 each comprise an elongated rectangular plate 44 having a substantially smooth planar inwardly directed face surface and having rigid mounting bracket assemblies 46, one spaced inwardly from each end of the plate 44 on thin outwardly facing or back surface. Each mounting bracket assembly 46 comprises an open, vertically extending cylindrical sleeve 48 rigidly welded, as by gussets 50, to the back surface of the plate 44, with the sleeves 48 extending in outwardly spaced relation to the plate. A reinforcing flange 52 is welded to and extends along the back surface of plates 44 between brackets 46, and a triangular shaped reinforcing gusset 54 is welded between the sleeve 48 and reinforcing flange 52.

The sleeves 48 are each adapted to be telescopingly received on the upwardly projecting end portion 56 of a support post 58. Posts 58 have thin lower end portion rigidly secured, as by bracket 60 and bolts 62, to the central web of the frame member 34. Collar 64 welded on the posts 58 limits the downward movement of the sleeves 48 on the top portion of the posts to thereby position the fence plate 44 vertically so that its bottom edge extends slightly below and in close proximity to the top conveying surface of the rolls 18 as most clearly seen in FIG. 4.

The two posts 58 which support the opposed ends of each plate 44 are connected, at a point below the collar 64, by a longitudinally extending brace 66. Bolted clamp members 68 connect the ends of brace 66 to the posts 58. Similarly, the two posts 58 which support corresponding ends of the fence plates 44 on opposed sides of the runout table are connected by a brace member 70 connected, as by bolts 74 and weldment 72, to the respective posts 58. Thus, the four posts 58 employed to support an opposed pair of fence plate assemblies 43 are connected by a rectangular set of braces or reinforcing pipes to provide dimensional stability to the structure.

The improved containment fence structure illustrated in FIGS. 3–5 is currently under test on an 80-inch hot strip mill runout table in which the driven conveyor rollers 18 are located on 18-inch centers. Each fence plate 44 spans 8 such rollers and is dimensioned to overlap the next succeeding fence plate 44. The posts 58 supporting each plate are 9 feet apart, with 6 conveyor rollers located therebetween and two rollers located between the posts supporting one end of a fence plate 44 and the adjacent end of the next successive fence plate on each side of the conveyor. It is understood that the length of each fence plate 44 may vary and the number of rollers spanned by each fence plate will depend on the diameter and spacing of the rollers as well as the length of the fence plate. To facilitate runout table maintenance, however, it is preferred that each fence plate have a length to span at least five and preferably eight or more rollers.

As can be seen from FIG. 5, the successive plate assemblies of 43 on each side of the runout table have their adjacent ends extending in overlapping or fish scale-like relation. To accomplish this, the length of the gussets 52 on the downstream end of the respective plate assemblies are longer than the corresponding gussets on the upstream end by an amount equal to the thickness of the plate 44. This arrangement requires the plate assemblies to always be installed with the longer gussets downstream whereby the upstream end of the plate 44 is always outboard of and shielded by the previous plate assembly so that no free edges are presented along the fence to engage and damage a strip moving on the runout table. The plate assemblies 43 are symmetrical about the horizontal center plane of the elongated reinforcing flange 52 so that the individual plate assemblies 43 may be simply inverted for use on either side of the runout table with opposite ends of the cylindrical sleeves 48 being received on the posts 58 on opposite sides of the runout table.

In an alternate embodiment, the gussets 52 on each end of assemblies 43 are of equal length and a shim, not shown, having the thickness of the plate 44 is employed between the mounting bracket 60 and the web of the beams 44 mounting the posts 58 which support the upstream end of the respective plate assemblies. This arrangement enables the plate assemblies to be mounted with either end in the upstream direction and to be mounted on either side of the runout table so that all plate assemblies are completely interchangeable. This arrangement requires the upstream cross braces 70 to be slightly longer than those at the downstream end of each plate due to the increased distance between opposing upstream posts 58 because of the shims.

In a further embodiment, the sleeves 48 may be replaced with a bracket which is bolted directly to a mounting bracket on the posts 58. This provides more strength and stability but requires some additional time for disassembly and assembly for maintenance of the rollers and bearings of the runout table.

From the above description, it will be readily apparent that a plate assembly 43 of the type illustrated in the drawings may be easily lifted from the supporting posts 58 to provide ready access to the rollers and support bearings of the runout table for maintenance purposes. Although longitudinally extending reinforcing members 66 extend above the bearing blocks 40, these reinforcing members too can be easily removed simply by removing two bolts at each end of the respective braces 66. Further, since the containment fence is supported from the vertical posts, the runout table rollers and bearing structures are more readily visible from the sides of the runout table to facilitate inspection. Thus, it is seen that this relatively simple containment fence structure provides substantial advantages over the prior art containment fences both from the standpoint of completely eliminating the possibility of an outwardly projecting plate edge obstructing and possibly damaging the hot strip moving on the runout table, but also from the standpoint of facilitating maintenance of the runout table.

While preferred embodiments of the invention have been disclosed and described, it should be apparent that the invention is not so limited and it is intended to include all embodiments of the invention which would be apparent to one skilled in the art and which come within the spirit and scope of the invention.

What is claimed is:

1. In a runout table for use with a hot strip finishing line for conveying rolled hot strip from the last mill stand through a cooling zone to a coiler spaced a substantial distance from the last stand, the runout table including a roller conveyor defined by a series of driven rollers supported on a rigid frame to define a conveyor path and a containment fence extending along each side of the driven roller conveyor adjacent the ends of and projecting above the rollers in position to engage the side edge of a strip which drifts to one side of the conveyor during movement therealong to thereby contain the strip on the conveyor between the containment fences, the improvement wherein each said containment fence comprises, a plurality of vertically extending posts mounted in fixed relation to and outboard of said rollers along each side of the runout table, said posts each terminating in a top end spaced above the conveying path defined by the rollers, a plurality of fence plate assemblies each including an elongated, generally rectangular plate and a pair of rigid mounting brackets on and extending outwardly from one surface of the elongated plate one adjacent each end thereof, said mounting brackets each including means engaging and cooperating with the upwardly projecting end of one of said posts to support said elongated fence plates inboard of said posts and adjacent to the ends of the rollers of the conveyor, said plate assemblies each having a length to extend past the ends of a plurality of adjacent rollers of said conveyor, said posts and said mounting brackets supporting said elongated plates in overlapping relation along the length of said conveyor path, with the downstream end of each elongated plate extending inboard of the upstream end of the next adjacent elongated plate whereby said elongated plates along each side of the conveyor path form a continuous fence free from protrusions capable of impeding movement of a strip along the conveying path.

2. The invention defined in claim 1 wherein each said fence plate has a length to extend past the ends of at least five rollers of said conveyor.

3. The invention defined in claim 2 wherein each said mounting bracket includes a sleeve adapted to telescopingly receive said top end of one of said posts to thereby releasably support said elongated plates in fixed outwardly spaced relation to the ends of the rollers of said conveyor.

4. The invention defined in claim 1 wherein said mounting brackets on each fence plate assembly are dimensioned to position the downstream end of each elongated plate closer to the rollers of the conveyor than the upstream end whereby the adjacent ends of the elongated plates along each side of the conveyor are held in overlapping relation.

5. The invention defined in claim 4 wherein said fence plate assemblies are symmetrical about their longitudinal horizontal center plates whereby each may be inverted and used on either side of the conveyor.

6. The invention defined in claim 5 wherein each said fence plate has a length to extend past the ends of at least five rollers of said conveyor.

7. The invention defined in claim 6 wherein each said mounting bracket includes a sleeve adapted to telescopingly receive said top end of one of said posts to thereby releasably support said elongated plates in fixed outwardly spaced relation to the ends of the rollers of said conveyor.

* * * * *